US007533734B2

(12) United States Patent
Fore et al.

(10) Patent No.: US 7,533,734 B2
(45) Date of Patent: May 19, 2009

(54) PNEUMATIC PUNCTURE DEVICE FOR AIRCRAFT FIRE SUPPRESSION SYSTEMS

(75) Inventors: Robert J. Fore, Irvine, CA (US); William John Dowicki, Westminster, CA (US); Ted Dinh, Brea, CA (US); Michael P. Torche, Lake Forest, CA (US); Gerald G. Steele, Marina Del Ray, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 351 days.

(21) Appl. No.: 11/376,019

(22) Filed: Mar. 15, 2006

(65) Prior Publication Data

US 2006/0219416 A1 Oct. 5, 2006

Related U.S. Application Data

(60) Provisional application No. 60/661,849, filed on Mar. 15, 2005.

(51) Int. Cl.
*A62C 2/00* (2006.01)

(52) U.S. Cl. ..... 169/46; 169/44

(58) Field of Classification Search ..... 169/46, 169/44, 62, 13–16; 239/271, 272
See application file for complete search history.

(56) References Cited

U.S. PATENT DOCUMENTS

| | | | | | |
|---|---|---|---|---|---|
| 1,484,888 | A * | 2/1924 | Johnson | 239/204 |
| 2,106,043 | A * | 1/1938 | Urquhart et al. | 261/76 |
| 3,342,271 | A * | 9/1967 | Anthony, Jr. | 169/15 |
| 3,848,675 | A * | 11/1974 | Evans | 169/15 |
| 4,124,077 | A * | 11/1978 | Barge | 169/70 |
| 4,318,443 | A * | 3/1982 | Cummins | 169/15 |
| 4,349,054 | A * | 9/1982 | Chipman et al. | 141/1 |
| 4,625,808 | A * | 12/1986 | Halfpenny | 169/30 |
| 4,981,178 | A * | 1/1991 | Bundy | 169/9 |
| 5,261,150 | A * | 11/1993 | Grube et al. | 29/560 |
| 5,349,755 | A * | 9/1994 | Haywood | 30/443 |
| 5,368,106 | A * | 11/1994 | Coughlin | 169/70 |
| 5,370,268 | A * | 12/1994 | Adams | 222/1 |
| 5,841,038 | A * | 11/1998 | Volz | 73/863.85 |
| 6,086,052 | A * | 7/2000 | Rowe | 261/18.1 |
| 6,217,009 | B1 * | 4/2001 | Rowe | 261/78.2 |
| 6,334,490 | B1 * | 1/2002 | Dille | 169/62 |
| 6,755,259 | B2 * | 6/2004 | Peltola et al. | 169/47 |
| 2001/0054964 | A1 * | 12/2001 | Popp et al. | 340/584 |
| 2003/0010506 | A1 * | 1/2003 | Braun et al. | 169/14 |
| 2004/0016552 | A1 * | 1/2004 | Ozment | |
| 2005/0263297 | A1 * | 12/2005 | Dimarzo et al. | 169/15 |

* cited by examiner

*Primary Examiner*—Len Tran
*Assistant Examiner*—Daniel T Sharpe
(74) *Attorney, Agent, or Firm*—Renner, Otto, Boiselle & Sklar, LLP

(57) ABSTRACT

A fire suppression device characterized by a plunger that is extendible from a housing for delivery of a fire suppressant foam. The plunger may be equipped at its outer end with a puncture tip that can penetrate through the wall of a container or cargo cover for delivery of the fire suppressant foam directly to the cargo, preferably after full or almost full extension of the plunger. The plunger may be driven outwardly under high force by a pressurized gas that may also be used as a propellant for mixing with a liquid foaming agent, preferably within a foaming chamber carried by the piston. Provision may also be made for connection to a source of pressurized fluid to effect retraction of the plunger.

8 Claims, 5 Drawing Sheets

PNEUMATIC PUNCTURE DEVICE FOR AIRCRAFT FIRE SUPPRESSION SYSTEMS

RELATED APPLICATION

This application claims the benefit of U.S. Provisional application No. 60/661,849 filed Mar. 15, 2005, which is hereby incorporated herein by reference in its entirety.

FIELD OF THE INVENTION

The invention herein described relates generally to fire suppression systems and more particularly to a pneumatic puncture system for such fire suppression systems.

BACKGROUND

Every day freight is shipped using various modes of shipping including trucks, trailers and aircraft. The freight is usually shipped inside storage areas and/or containers and some freight can be composed of flammable material. The freight often is stored in an area separate from personnel handling or watching over the truck, trailer, aircraft or storage facility. Consequently, the start of a fire in a container or storage area may go undetected for a prolonged period of time. Once a fire condition has been detected, the container or storage area in which the fire is located may not be immediately known because many different containers may be located in a storage area. Even when the fire is detected and the involved container located, access to the container may be difficult, as in the case where a number of containers are located in an aircraft cargo area in close-packed arrangement.

Freight carried by modern commercial freighter aircraft usually is transported in containers or on pallets. The containers or pallets are generally referred generically as Unit Load Devices or "ULDs". The containers may be constructed of high-strength aircraft grade aluminum alloy, sometimes with sides constructed partially of Lexan polycarbonate. Under Federal Air Regulations, ULDs are considered aircraft appliances, are FAA certified for the specific type of aircraft, and are typically manufactured to specifications contained in National Aerospace Standard (NAS) 3610. An example of a very commonly used ULD for main deck freight stowage is an AMJ-type container configured to fit within the main deck stowage area. A number of these containers and/or pallets may be stored in a cargo area of the aircraft.

If a container contains flammable material and the temperature rises too high or the material is otherwise ignited, a fire could start in the container. Unless someone is in the cargo area at the time the freight combusts, which is unlikely, such a fire could remain undetected by the ground and/or flight crew. If undetected, the fire could spread to other containers or areas and compromise the aircraft.

U.S. Published Patent Application No. 2001/0054964 discloses a system for detecting and suppressing a fire condition in a storage unit. Sensors are provided to detect a fire condition and transmit detection of such an event to a control center, such as the cockpit of an aircraft. In addition, a fire suppression device is configured to discharge a fire suppressant material into the storage unit upon detection of the fire condition. In the case of a plurality of storage units, a plurality of sensors are employed along with a plurality of fire suppression devices for respective storage units.

The fire suppression devices disclosed in the above-mentioned published application include a source of pressurized fire suppressant material and a popup device disposed between one of the storage units and the source. The popup device is configured to apply the fire suppressant material to the storage unit upon detection of the fire condition. The storage unit may be a container with a base including a hole, and the popup device may include a valve aligned with the hole, such that the fire suppressant material is discharged into the container through the hole in the base. In an aircraft fire suppression system, the fire suppressant material may be centrally located and distributed via a manifold to the storage units.

Other fire suppression devices have used a liquid foaming agent and a pressurized gas for agitating and aerating the foaming agent to generate a foam. It has been proposed to provide an aircraft fire suppression system with respective supplies of a liquid foaming agent and pressurized gas that are connected to a plurality of fire suppression devices respectively associated with container and/or pallet locations in an upper deck freight storage area of an aircraft. The fire suppression devices each would be individually actuated upon detection of a fire condition in the associated container or pallet. A further proposal was to provide such a fire suppression device that could penetrate the container or pallet cover to deliver fire retardant foam directly to the contents of the container or pallet.

SUMMARY OF THE INVENTION

The present invention provides a fire suppression device characterized by a plunger that is extendible from a housing for delivery of a fire suppressant foam. The plunger may be equipped at its outer end with a puncture tip that can penetrate through the wall of a container or cargo cover for delivery of the fire suppressant foam directly to the cargo, preferably after full or almost full extension of the plunger. The plunger may be driven outwardly under high force by a pressurized gas that may also be used as a propellant for mixing with a liquid foaming agent, preferably within a foaming chamber carried by the piston. Provision may also be made for connection to a source of pressurized fluid to effect retraction of the plunger.

Accordingly, the invention provides a fire suppression device for dispensing a fire retardant foam into an aircraft cargo compartment, comprising a housing including a piston chamber, a gas inlet for connection to a source of pressurized gas, a gas flow passage for connecting the gas inlet to an extend side of the piston chamber, and a foaming agent inlet for connection to a source of a foaming agent; a plunger including a piston movable in the piston chamber between a retracted position and an extended position when pressurized gas is supplied to the extend side of the piston chamber via the gas inlet and gas flow passage; and a foaming chamber a discharge opening through which fire retardant foam is dispensed from the foaming chamber, the foaming chamber being connected at its inlet end by an inlet passage that communicates with the foaming agent inlet when the plunger is in its extended position.

The plunger may include the foaming chamber, which may be in the form of a foaming cartridge. The plunger may include a plunger gas passage for connecting the extend side of the piston chamber to the foaming chamber, and a valve member for opening and closing the plunger gas passage respectively to permit or restrict the flow of pressurized gas from the extend side of the piston chamber to the foaming chamber via the plunger gas passage. A plunger position-responsive actuator may be provided for moving the valve member to an open position when the plunger reaches its extended position, thereby allowing the pressurized gas to flow into the foaming chamber for mixing with the foaming agent.

The housing may also includes a second gas inlet for connection to a source of pressurized gas, and a second gas flow passage connecting the second gas inlet to a retract side of the piston chamber in the housing. The inlet may open to a side of the plunger such that it becomes exposed to the retract side of the piston chamber during retraction of the plunger, and the plunger may include a poppet valve for closing the inlet passage to the foaming chamber when pressurized gas is supplied to the second gas inlet, thereby to prevent the pressurized gas from escaping through the foaming chamber.

According to another aspect of the invention, a fire suppression device for an aircraft cargo compartment fire suppression system, comprises a housing including a piston chamber, a gas inlet for connection to a source of pressurized gas, a gas flow passage for connecting the gas inlet to an extend side of the piston chamber, and a foaming agent inlet for connection to a source of a foaming agent; and a plunger including a piston movable in the piston chamber between a retracted position and an extended position when pressurized gas is supplied to the extend side of the piston chamber via the gas inlet and gas flow passage, the plunger being configured to receive therein a cartridge including a foaming chamber, and the plunger including foaming agent flow passage communicating with the foaming agent inlet when the plunger is in its extended position. The plunger may be releasably held in the retracted position by a retention device until gas pressure in the extend side of the piston chamber exceeds a prescribed amount. The retention device may include a coil spring having one side thereof protruding laterally from a side wall of one of the plunger and housing and releasably captured by a side wall of the other of the plunger and housing.

According to a further aspect of the invention, a method of operating a fire suppression device for dispensing a fire retardant foam into an aircraft cargo compartment, comprising the steps of using a pressurized gas to extend a plunger from a housing under sufficient force to allow a puncture tip at the end of the plunger to penetrate a container wall or cargo cover; and automatically dispensing from a discharge end of a foaming chamber a fire retardant foam upon the plunger reaching an extended position. The method may further comprise the step of allowing the pressurized air to enter the foaming chamber upon the plunger reaching the end of an extend stroke, for mixing with a foaming agent supplied to the foaming chamber, and the step using a second pressurized gas to retract the plunger after it has been extended, to reposition the plunger at a retracted position in the housing.

The foregoing and other features of the invention are hereinafter more fully described and particularly pointed out in the claims, the following description setting forth in detail certain illustrative embodiments of the invention, these being indicative, however, of but a few of the various ways in which the principles of the invention may be employed.

DETAILED DESCRIPTION

The principles of the present invention can be applied in various types of fire suppression systems, as will be appreciated by those skilled in the art. The present invention, however, is particularly applicable to aircraft fire suppression systems used to protect cargo stowage areas such as those which can contain a plurality of ULDs such as cargo containers and covered pallets. Accordingly, an exemplary embodiment of the invention will be described in relation to such type of aircraft fire suppression system, although it should be understood that the invention can be applied to other types of fire suppression systems as well.

Figure 1:
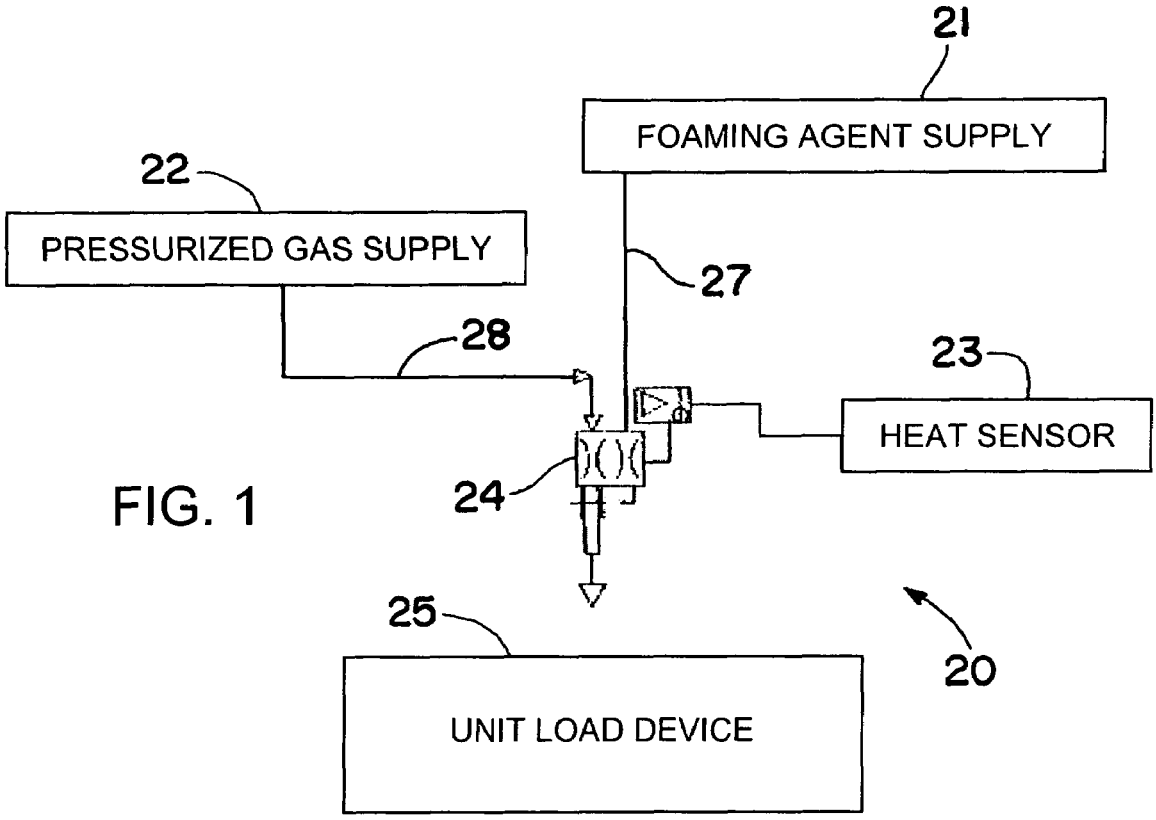
FIG. 1 is a schematic representation of an exemplary fire indication and suppression system which includes a fire suppression device according to the invention.

Referring initially to FIG. 1, an aircraft fire suppression system is indicated generally at 20. The system 20 comprises a foaming agent supply 21, a pressurized gas supply 22, a heat sensor 23 and a fire suppression device 24, all shown in diagrammatic relation to a ULD 25 (such as a container or pallet) in a cargo storage space of an aircraft. The heat sensor 23 is used to monitor the ULD 25 for a condition indicative of a fire, such as a temperature significantly higher than the ambient temperature in the cargo storage space. The heat sensor may be, for example, an infrared sensor that looks at the infrared signature of the ULD.

The fire suppression device 24, which is described in greater detail below, is connected via suitable piping 27 to the supply 21 of a foaming agent which typically will be a liquid. The device 24 also is connected via suitable piping 28 to the source 22 of a pressurized gas, such as nitrogen gas or other nonflammable gas compatible with the foaming agent. The gas typically will be a nonflammable gas that is mixed with the foaming agent as a propellant and/or reactant for the generation of a fire retardant foam that is dispensed by the fire suppression device.

If the heat sensor 23 detects a fire condition, the fire suppression device 24 is caused to deploy a plunger that may be equipped with a puncture tip that can penetrate an exterior wall of the ULD 25 so that the dispensing end of the plunger will be located inside the ULD for delivery of the fire retardant foam directly to the contents of the ULD. After the plunger is deployed, the pressurized gas is mixed with the foaming agent for producing and dispensing the fire retardant foam. The heat sensor 23 may also supply a signal to the cockpit to alert the flight crew of a fire situation in the cargo storage area.

Since most aircraft can carry a plurality of ULDs, a heat sensor and fire suppression device may be provided at each ULD location. Separate foaming agent tanks and pressurized gas tanks may be provided for each station, or multiple fire suppression devices may be connected to a common foaming agent tank (or tanks) and pressurized gas tank (or tanks).

Figure 2:
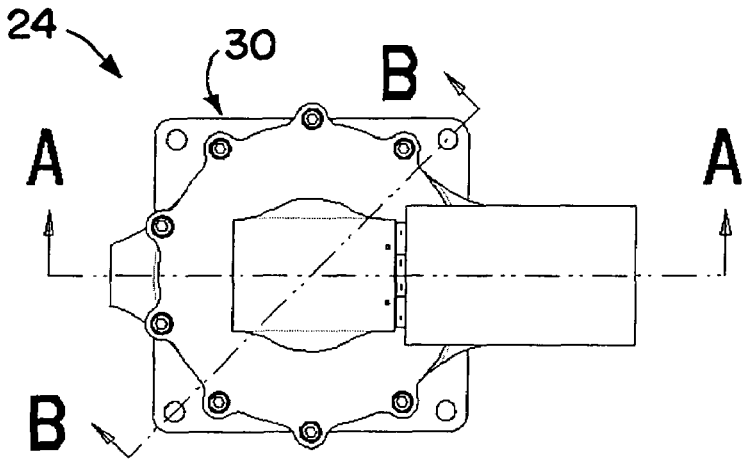
FIG. 2 is an end view of an exemplary fire suppression device according to the invention.
Figure 3:
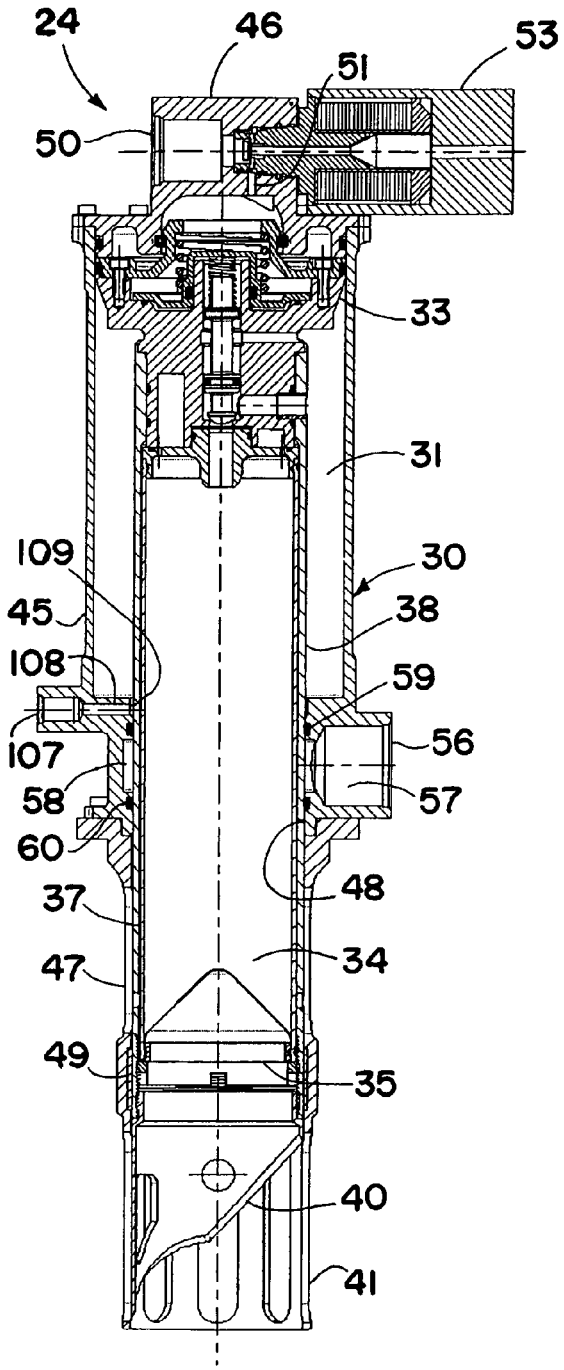
FIG. 3 is a cross-sectional view of the fire suppression device, taken along the line A-A of FIG. 2, showing the device in an un-deployed, retracted position.
Figure 4:
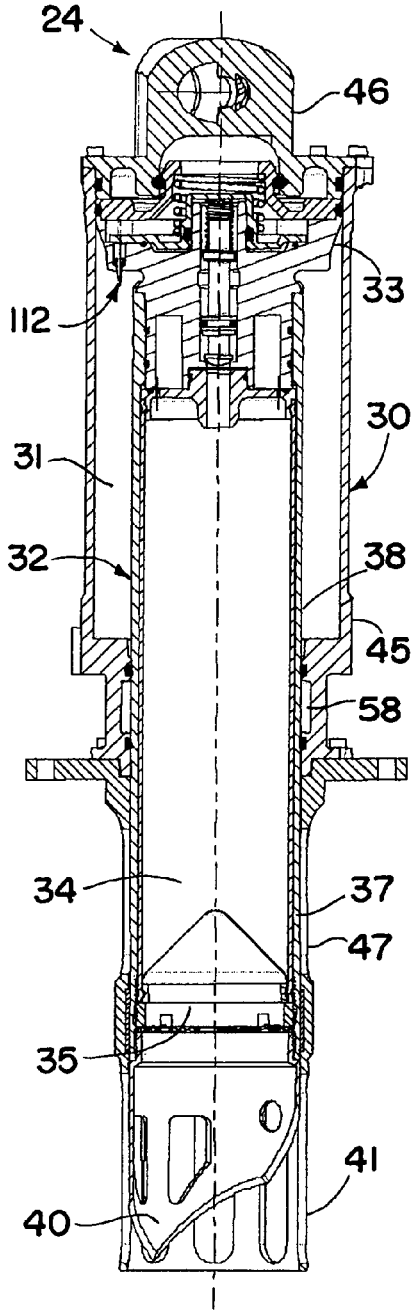
FIG. 4 is a cross-sectional view of the fire suppression device, taken along the line B-B of FIG. 2, showing the device in an un-deployed, retracted position.
Figure 8:
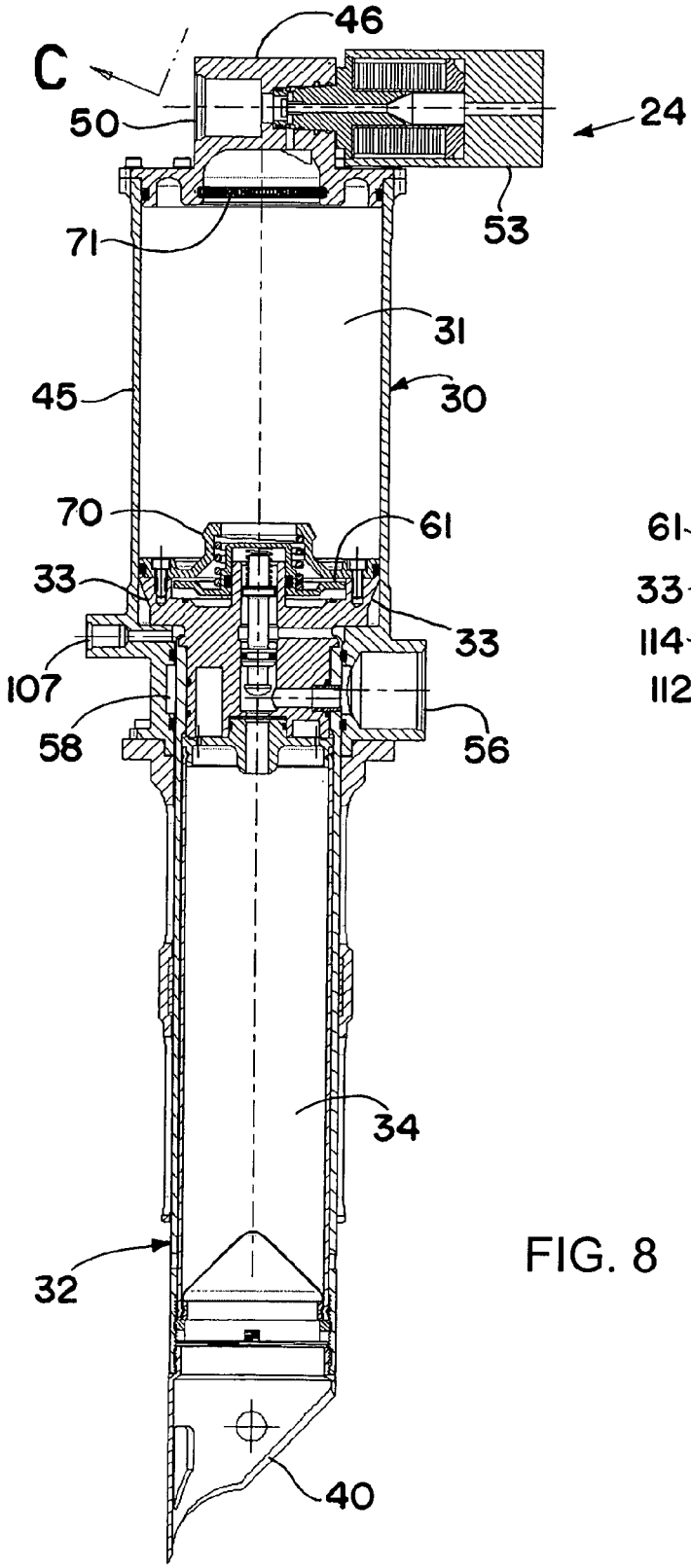
FIG. 8 is a cross-sectional view of the fire suppression device similar to FIG. 3, but showing the device in a deployed, extended position.
Figure 7:
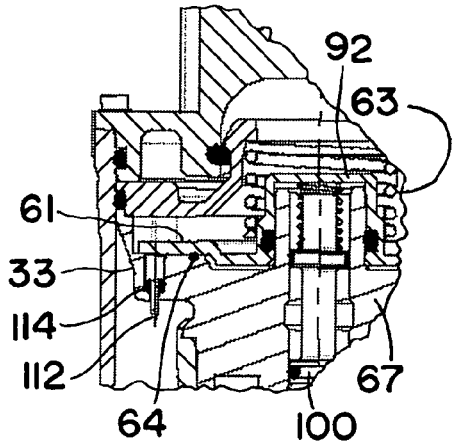
FIG. 7 is an enlargement of a portion of FIG. 6.

Turning now to FIGS. 2-4, the illustrated exemplary fire suppression device 24 can be seen to comprise a housing 30 including a piston chamber 31, a plunger 32 including a piston 33 movable in the piston chamber between a retracted position (FIGS. 3 and 4) and an extended position (FIGS. 8-10), and a foaming chamber 34 having a discharge opening 35 through which fire retardant foam is dispensed from the foaming chamber. The foaming chamber may be formed in a cartridge 37 inserted into a lower tubular portion 38, or stem, of the plunger and suitably secured within the plunger stem by suitable means. The discharge opening 35 of the foaming chamber opens to the interior of an annular puncture tip 40 that has an angled knife edge and which may be secured to the outer end of the plunger. In the retracted position of the plunger shown in FIGS. 3 and 4, the puncture tip may be surrounded by a tubular protective guard 41 attached to or forming a part of the housing 30.

The housing 30 may be assembled from several parts including a tubular body 45, an end cap 46, a lower body extension 47 and the above mentioned protective guard 41 which may be unitary with the lower body extension as shown. As illustrated, the tubular body 45 may have a cylindrical wall portion forming the piston chamber 31 which is closed at one end by the end cap 46. The other end of the piston chamber is closed by a lower end portion of the tubular body 45 that has a central passage 48 through which the stem portion 38 of the plunger is supported for sliding telescopic movement. The plunger may also be supported by a bushing 49 retained in the lower body extension.

The end cap 46 includes a gas inlet 50 for connection to the source 22 (FIG. 1) of pressurized gas, and a gas flow passage 51 for connecting the gas inlet to an extend side of the piston chamber. The flow of pressurized gas through the end cap may be controlled by a valve 53, such as a solenoid valve secured to the end cap at a threaded port. The control valve 53 may be opened in response to a signal from the heat sensor 23 (FIG. 1) signaling a fire condition and initiating deployment of the fire suppression device 24.

The lower end portion of the body 45 has a foaming agent inlet port 56 for connection of the fire suppression device to the foaming agent supply 21 (FIG. 1). The inlet port 56 is connected via a radial passage 57 to an opening, specifically an annular chamber 58 formed in the inner diameter surface of the lower housing end portion. As shown, suitable annular seals 59 and 60 are provided to seal the plunger stem 38 to the lower body end portion at opposite axial sides of the annular chamber 58 to seal against fluid leakage along the stem of the plunger. When the plunger is retracted as shown in FIGS. 3 and 4, the plunger stem will block and thus close the chamber 58. Consequently, the foaming agent inlet port 56 can always be connected to the foaming agent supply 21 even though the latter typically will be under pressure for delivery of the foaming agent to the fire suppression device.

Figure 5:
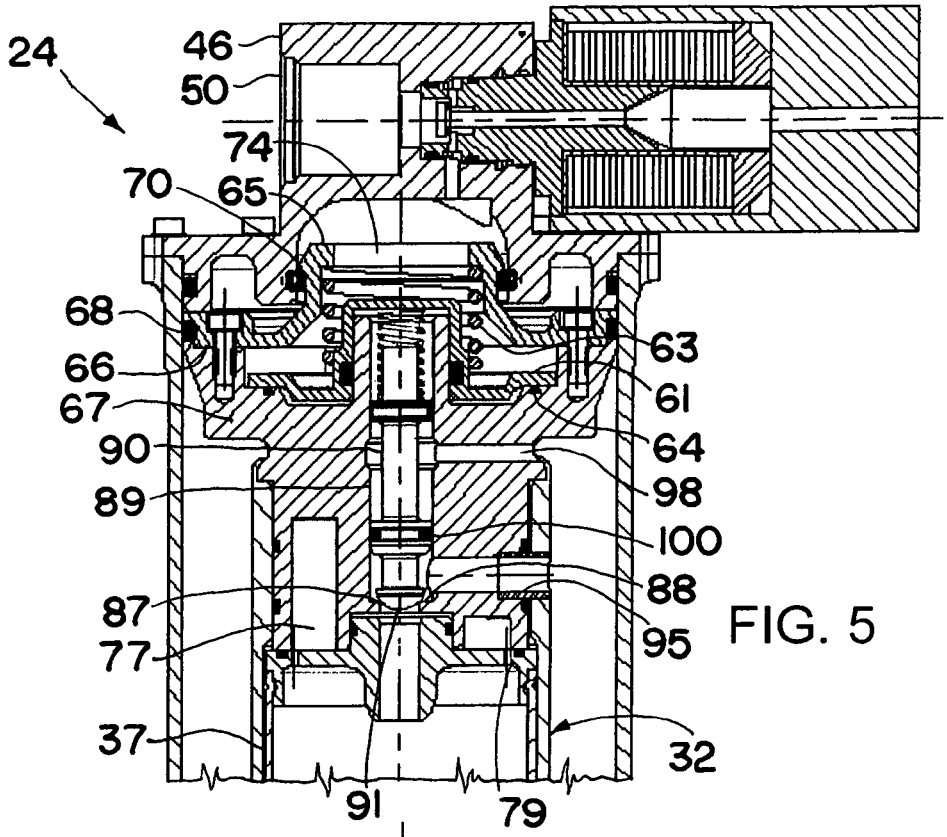
FIG. 5 is an enlargement of the upper portion of FIG. 3.
Figure 6:
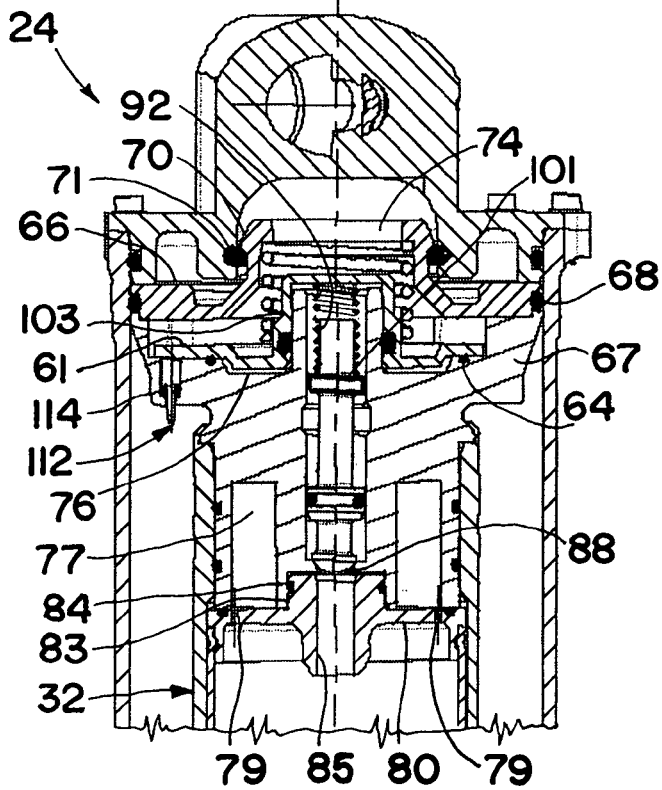
FIG. 6 is an enlargement of the upper portion of FIG. 4.

The plunger 32 includes one or more axial passages 60 (FIG. 10) for connecting the extend side of the piston chamber 31 to the foaming chamber 34, and a valve member 61 for opening and closing the plunger gas passages 60 to permit or restrict the flow of pressurized gas from the extend side of the piston chamber to the foaming chamber via the plunger gas passages. In the illustrated embodiment and as best seen in FIGS. 5 and 6, the valve member 61 is a disc-like member that is resiliently biased by a spring 63 against an annular seal 64 that forms an annular valve seat. The spring 63 is axially interposed between the valve member 61 and the bottom of a well 65 formed in a piston end plate 66. The piston end plate is secured to a piston body 67 and has an annular groove at its outer diameter in which an annular piston seal ring 68 is trapped to effect a sliding seal between the piston and piston chamber wall.

As seen in FIGS. 5 and 6, the well 65 has on its outer diameter surface a ledge 70 for interacting with a retention device 71 that releasably holds the plunger in its retracted position. In the illustrated embodiment, the retention device 71 includes a coil spring circumferentially retained in a groove in the housing end cap 46. The coil spring protrudes radially inwardly from the groove to catch the ledge 70 for releasably latching the piston to the end cap. The plunger will be retained in the retracted position until pressure applied to extend the piston produces enough force to cause the coils of the spring to collapse on themselves thereby releasing the ledge to allow the plunger to extend. The spring coils will resiliently return to their uncompressed condition after passage of the ledge thereby.

The annular well 65 has a central opening 74 for passage of pressurized gas from the inlet 50 to the backside of the valve member 61 such that pressurized gas will also serve to hold the valve member seated against the annular valve seat 64. The annular seal/valve seat surrounds an annular well 76 that is connected to an annular manifold chamber 77 by the axial passages 60 (see FIG. 10) in the plunger 32. The annular chamber 77 serves as a manifold for a supplying pressurized gas to the foaming cartridge 37 and more specifically to a ring of inlet openings 79 in the top wall 80 of the cartridge. When the valve member 61 is closed against the valve seat 64 as shown in FIGS. 5 and 6, pressurized gas is blocked from flowing from the inlet 50 to the foaming cartridge 37.

The top wall 80 of the foaming cartridge 37 has a central tubular nipple 83 that fits in a correspondingly sized counterbore at the top end of the cartridge chamber in the plunger, which nipple is provided with an annular seal 84 for sealing to the plunger. The nipple has a central passage 85 for connecting the interior of the foaming cartridge to an central axial passage 87 in the plunger. The central passage 87 opens at a poppet valve seat 88 to a larger diameter chamber 89 in which a poppet valve member 90 is disposed for axial movement. The poppet valve member 90, which has a valve head 91, is normally biased by a spring 92 to seat the valve head against the seat. The poppet valve chamber 89 has a lower portion communicating with a radial passage 95 that opens to the exterior of the plunger stem at the retract side of the piston. The poppet valve chamber also has an intermediate portion that is connected by a radial passage 98 to the exterior of the plunger at a location axially between the radial passage 95 and the piston 66.

The poppet valve member 90 has a valve stem provided with a radially enlarged piston portion 100 sealed to the poppet chamber between the radial passages 95 and 98. The poppet valve member also a annular shoulder 101 engaged by one end of the spring 92. The other end of the spring engages the bottom of a central cup portion 103 of the valve members 61. The central cup portion has a cylindrical interior wall surface that slides on a correspondingly sized post of the piston body 67 to maintain the valve member perpendicular to the valve seat during axial movement of the valve member. As shown, the interface between the cup portion and post is sealed to prevent fluid communication between the poppet valve chamber 89 and the pressurized gas flow passage in the plunger piston 33.

When the control valve 53 is opened to allow pressurized gas to enter the extend side of the piston chamber 31, gas pressure will cause the plunger 32 to extend from the housing. As above indicated, the valve member 61 will be held closed to prevent pressurized gas from passing through the plunger to the foaming chamber 34. Fluid on the retract side of the piston will be exhausted through a port 107 connected via a passage 108 to a counterbore 109 at the end of the piston chamber 31 opposite the inlet for the pressurized gas.

The force acting on the plunger 32 causes the plunger to release from the spring retention device 71. In addition, the force preferably is such that the puncture tip 40 will be urged with sufficient force to penetrate through an adjacent wall of a ULD. As will be appreciated the wall of the ULD will need to be spaced from the end of the plunger by a distance less than the length of the stroke of the plunger to enable the plunger to engage and penetrate the ULD.

Figure 9:
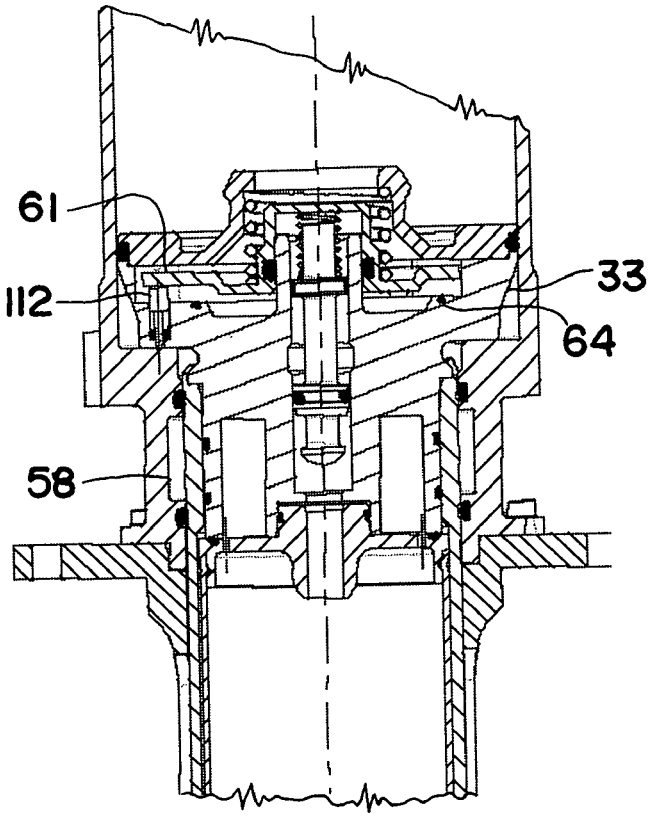
FIG. 9 is an enlarged partial cross-sectional view of the fire suppression device taken along the line B-B of FIG. 2, with the device in a deployed, extended position.
Figure 10:
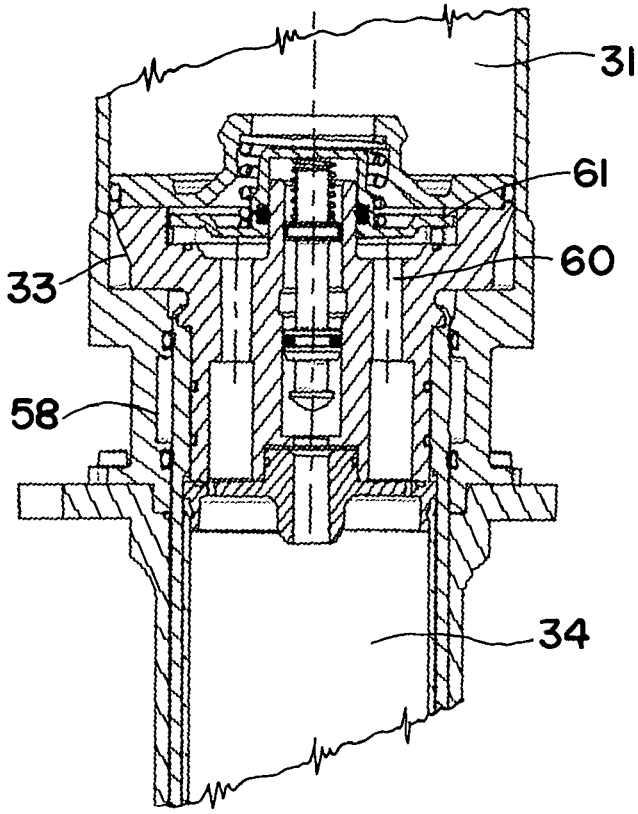
FIG. 10 is an enlarged partial cross-sectional view of the fire suppression device taken along the line C-C of FIG. 2, with the device in a deployed, extended position.

While the plunger 32 is being deployed, the valve member 61 will remain closed until the piston 33 reaches the end of the piston chamber 31. At this point a valve opening member 112 will force the valve member open against the spring force and fluid pressure acting to close the valve member against its valve seat 69. As seen in FIG. 6, the valve opening member 112 can be an axially extending pusher pin that normally projects from the retract side of the piston. The pusher pin is positioned to engage the bottom of the piston chamber when the piston reaches the end of its extend stroke as seen in FIG. 9. Until such engagement the pusher pin will be held in the position shown in FIG. 6. The pressurized gas will be precluded from passing through the hole in the piston through which the pusher pin extends by reason of a seal 114 surrounding a reduced diameter stem portion of the pusher pin. The piston has an enlarged head portion that cannot fit through the hole for the stem, whereby the pin is axially trapped for limited axial movement between the valve member and the piston.

As the piston 33 reaches the end of the piston chamber, the pusher pin will be caused to move in the direction opposite the movement direction of the piston and this in turn will cause the pusher pin to push the valve member 61 off its valve seat 64. This will allow the pressurized gas to pass into the foaming chamber 34. At the same time, the side passage 95 in the plunger stem will become aligned with the annular chamber 58 in the housing 30 to which the foaming agent is being supplied, typically under pressure. With the plunger in the position shown in FIGS. 8-10, the foaming agent can now pass into the foaming chamber for mixing with the pressurized gas and dispensing of fire retardant foam from the discharge opening 35 of the foaming chamber and into the interior of the ULD. The pressure of the foaming agent will act on the poppet piston 100 and cause the poppet valve 90 to open to allow the foaming agent to pass into the foaming chamber.

After a fire event (or a test procedure), the control valve 53 is operated to close the main inlet 50. The plunger 32 can be retracted into the housing 30 by connecting the second pressurized gas inlet 107 to a source of pressurized gas, such as carbon dioxide gas from a supply thereof. This will cause pressurized gas to act on the retract side of the piston to move the plunger back into the housing. The pressurized gas will also flow through the side poppet passage 98 to act on the poppet piston 100 to close the poppet valve and thereby prevent the pressurized air from escaping through the foaming chamber 34 and its discharge opening. The pressure of the gas should be sufficient enough to force the retention post on the piston through the retention spring whereby once again the plunger will be releasably retained in its retracted position. The control valve 53, when de-energized, may serve to vent the extend side of the piston chamber 31 as the plunger is being retracted.

Although the invention has been shown and described with respect to a certain embodiment or embodiments, it is obvious that equivalent alterations and modifications will occur to others skilled in the art upon the reading and understanding of this specification and the annexed drawings. In regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A fire suppression device for dispensing a fire retardant foam into an aircraft cargo compartment, comprising:

a housing including a piston chamber, a gas inlet for connection to a source of pressurized gas, a gas flow passage for connecting the gas inlet to an extend side of the piston chamber, and a foaming agent inlet for connection to a source of a foaming agent;

a plunger including a piston movable in the piston chamber between a retracted position and an extended position when pressurized gas is supplied to the extend side of the piston chamber via the gas inlet and gas flow passage; and a foaming chamber having a discharge opening through which fire retardant foam is dispensed from the foaming chamber, the foaming chamber being connected at its inlet end by an inlet passage that communicates with the foaming agent inlet when the plunger is in its extended position;

wherein the housing includes a second gas inlet for connection to a source of pressurized gas, and a second gas flow passage connecting the second gas inlet to a retract side of the piston chamber in the housing; and wherein the second gas inlet opens to a side of the plunger such that it becomes exposed to the retract side of the piston chamber during retraction of the plunger, and the plunger includes a poppet valve for closing the inlet passage to the foaming chamber when pressurized gas is supplied to the second gas inlet, thereby to prevent the pressurized gas from escaping through the foaming chamber.

2. A device according to claim 1, wherein the plunger includes the foaming chamber.

3. A device according to claim 2, wherein the plunger includes a plunger gas passage for connecting the extend side of the piston chamber to the foaming chamber, and a valve member for opening and closing the plunger gas passage respectively to permit or restrict the flow of pressurized gas from the extend side of the piston chamber to the foaming chamber via the plunger gas passage.

4. A device according to claim 3, wherein the valve member is biased toward a closed position.

5. A device according to claim 4, including an actuator for moving the valve member to an open position when the plunger reaches its extended position, thereby allowing the pressurized gas to flow into the foaming chamber for mixing with the foaming agent.

6. A device according to claim 1, further comprising a puncture tip at the outer end of the plunger, the puncture tip being operative to penetrate a container wall upon extension of the plunger from the housing.

7. A device according to claim 1, wherein the plunger is releasably held in the retracted position by a retention device until gas pressure in the extend side of the piston chamber exceeds a prescribed amount.

8. A device according to claim 7, wherein the retention device includes a coil spring having one side thereof protruding laterally from a side wall of one of the plunger and housing and releasably captured by a side wall of the other of the plunger and housing.

* * * * *